US005855179A

United States Patent [19]

Wood

[11] Patent Number: 5,855,179

[45] Date of Patent: Jan. 5, 1999

[54] MID SHIPS TOW POINT FOR SINGLE LINE AND MULTI LINE TOWED ARRAYS

[75] Inventor: Edwin H. Wood, Portsmouth, R.I.

[73] Assignee: The United States of America as represented by the Secretary of the Navy, Washington, D.C.

[21] Appl. No.: 942,191

[22] Filed: Oct. 1, 1997

[51] Int. Cl.[6] ..... B63B 21/16

[52] U.S. Cl. ..... 114/254; 114/244; 114/312

[58] Field of Search ..... 114/312, 313, 114/242, 253, 254, 244, 333

[56] References Cited

U.S. PATENT DOCUMENTS

| | | | |
|---|---|---|---|
| 3,034,471 | 5/1962 | Aschinger | 114/244 |
| 3,961,589 | 6/1976 | Lombardi | 114/254 |
| 5,119,751 | 6/1992 | Wood | 114/242 |
| 5,263,431 | 11/1993 | Wood | 114/254 |
| 5,314,130 | 5/1994 | Wood et al. | 254/290 |
| 5,339,762 | 8/1994 | Waclawik et al. | 114/312 |

*Primary Examiner*—Sherman Basinger
*Attorney, Agent, or Firm*—Michael J. McGowan; Robert W. Gauthier; Prithvi C. Lall

[57] ABSTRACT

A towed array handling system is provided for installation within the enlarged sails of future submarines. The system has a large diameter reel which provides storage for the entire array and tow cable when not deployed. The area within the enlarged sail is sufficient to allow for a dual winch and reel system for separately storing and deploying single line and/or multi line arrays. The reel applies the full tension of the streamed array as it is deployed and retrieved. When locked, the reel applies the full array streaming tension during high speed tow. The towed array is ducted from the winch to a mid ships tow point via a guide path through a ballast tank which contains only two bends. The upper sheave at the bend closest to the winch is free wheeling and the lower sheave is part of a transfer device which pulls the array from the winch during the initial phase of deployment. The guide duct is aligned with the winch to provide even spooling of the array, especially the multi line array, onto the winch.

10 Claims, 2 Drawing Sheets

MID SHIPS TOW POINT FOR SINGLE LINE AND MULTI LINE TOWED ARRAYS

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to cable towing systems, and more particularly to a towed array handling system having a tow point located in the mid ships area of a submerged vessel.

(2) Description of the Prior Art

Current thin line towed arrays are deployed and retrieved from a submarine through a tow point located at the tip of the horizontal stabilizer as shown in U.S. Pat. No. 5,119,751 to Wood. That location is not only the best from the standpoint of the affects on ship maneuvering, but it is the only location which avoids entanglement and severing of the array in the ship's screw on submarines not equipped with a shrouded screw. The towed array handling system on submarines is located either in the aft ballast tank or in a mid ships area. From either of these positions, the towed array must be ducted through a long, curved guide tube extending from the handling equipment to the aft tow point. Even though equipped with rollers to reduce friction, the guide tube still increases the free stream drag on the array, thus necessitating the use of a dual capstan type traction device to reduce the array tension to a level considered safe for wrapping onto a storage reel. Current traction devices are designed with three foot diameter sheaves. Repeated cycling of the array over the guide tube rollers, in addition to repeated wrapping around the three foot diameter sheaves at elevated tensions, degrades the towed array structure and reduces the life of the towed array.

Future submarine sonar capabilities will demand either multiple, long, single line arrays or multi line arrays in which several shorter arrays are towed by a single tow cable. Furthermore, the arrays may be towed from two separate tow points. The aft ballast tanks are not expected to offer space for either a second handling system the size of the current single line handling system or a handling system capable of accommodating a multi line array. Tests performed on multi line arrays, especially those equipped with lateral force devices, have demonstrated that these arrays cannot be deployed or retrieved through a guide tube having multiple three dimensional curves; nor can the multiple arrays be detensioned on dual capstan type traction devices. The various studies and tests of handling system characteristics have determined that the following characteristics are necessary for handling multi line arrays: (1) A large diameter, narrow faced reel must be used for storage or the array and to apply the primary inhaul force for both the single line arrays and the multi line arrays; (2) The arrays must be ducted from the storage reel to the tow point via a guide duct having the minimum number of bends, the planes of which are coincident with the plane of the storage reel; and (3) A simple transfer device located in one of the bends must be used to assist the initial phase of deployment and to eliminate friction in the bend at retrieval.

SUMMARY OF THE INVENTION

Accordingly, it is an object of the present invention to provide a towed array handling system capable of storing both single line and multi line arrays.

Another object of the present invention is to provide a towed array handling system utilizing a large diameter reel.

Still another object of the present invention is to provide a towed array handling system having a guide duct with a minimum number of curves.

A further object of the present invention is to provide a towed array handling system which can utilize the space which will be available in future submarine sails.

A still further object of the present invention is to provide a towed array handling system which aligns the plane of the transfer device and the planes of the guide duct curves with the plane of the winch to effect even spooling of the array onto the winch.

Other objects and advantages of the present invention will become more obvious hereinafter in the specification and drawings.

In accordance with the present invention, a towed array handling system is provided for installation within the enlarged sails of future submarines. The system has a winch with a large diameter reel which also provides storage for the entire array and tow cable when not deployed. The area within the enlarged sail is sufficient to allow for a winch/storage reel system for storing and deploying single line and multi line arrays. The reel applies the full tension of the streamed array as it is deployed and retrieved. When locked, the reel applies the full array streaming tension during high speed tow. The towed array is ducted from the winch to the tow point via a guide path which contains two bends. The two bends in the guide path allow it to be routed to and through a ballast tank rather than through the submarine pressure hull as would be required by a more direct path. The upper sheave at the bend closest to the winch is free wheeling and imparts no additional tensile loads to the towed array. The lower sheave is part of a transfer device which pulls the array from the winch during the initial phase of deployment and which also eliminates any friction otherwise resulting from the bends in the path. Both sheaves have an effective diameter of at least 36". The guide duct is aligned with the winch to provide even spooling of the array, especially the multi line array, onto the winch. Even spooling distributes the array across the face of the winch and thus prevents array crossover. The guide duct is in line with and centered with the winch flanges and the plane of both curves are aligned with the plane of the winch flanges. The upper sheave and winch are separated a sufficient distance to enhance even spooling. Both the winch and the lower transfer device are powered by electric motors. With the alignment of the guide duct and winch, the array travel path is through a ballast tank, clearing the pressure hull of the submarine. The travel path places the tow point and shroud in an area where it will not extend below the keel or outside the beam of the submarine. The guide duct is welded into the ballast tank at both ends to maintain ballast tank integrity. Though future submarines are envisioned to contain propulsor shrouds, the submarine may have to execute a turning maneuver during initial array deployment to assure that the aft end of the array will be carried away from and, thus, avoid possible ingestion into the propulsor. After the end of the array passes the propulsor shroud, the shroud will prevent entanglement in the screw during subsequent maneuvers. If necessary, additional separation of the tow cable from the hull can be achieved by suitable weighting of the tow cable with a wrap of lead armor wires.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
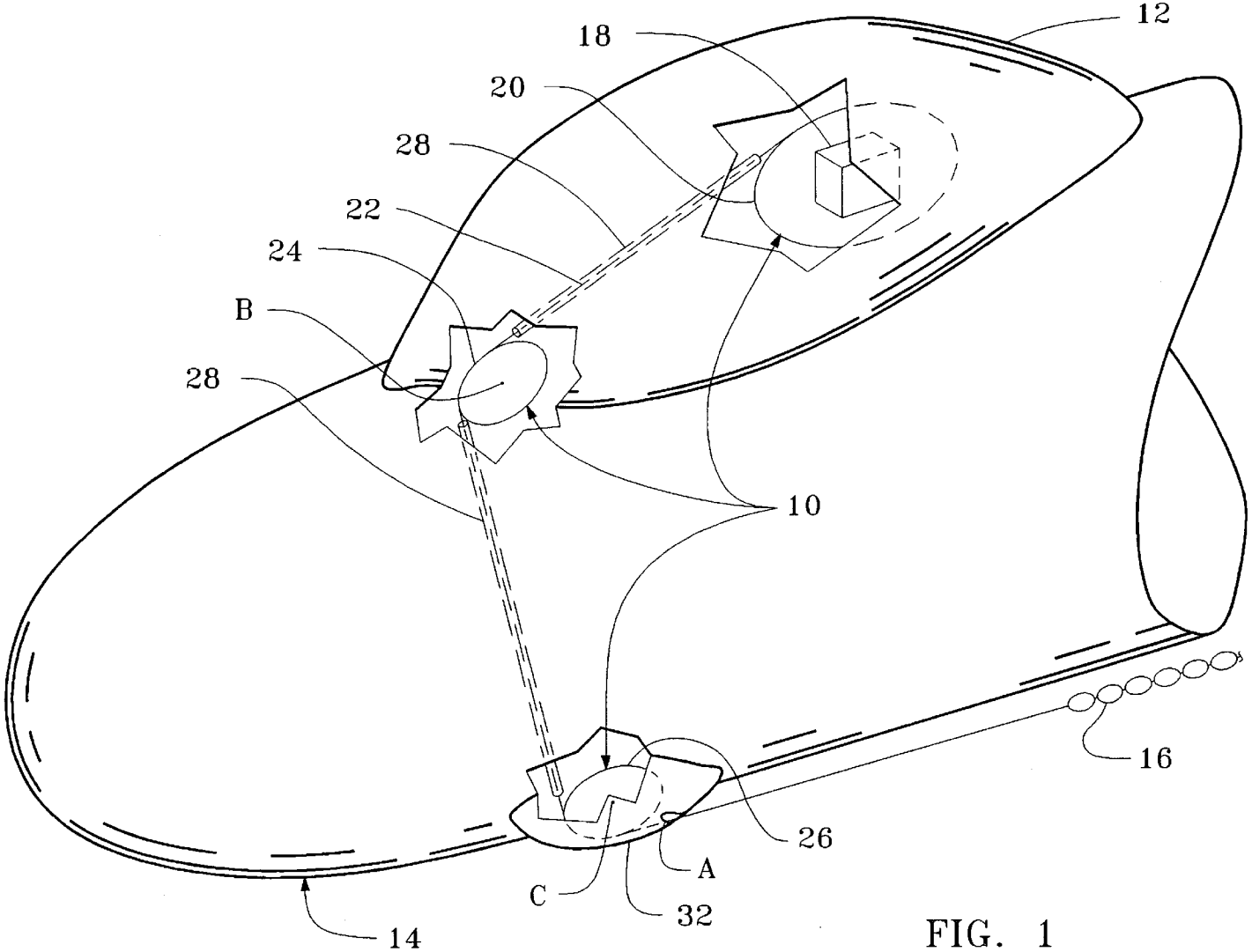
FIG. 1 is a schematic representation of the mid ships tow point single line/multi line towed array handling system of the present invention installed in a future submarine.

Referring now to FIG. 1, there is shown a schematic, cut-away representation of the handling system 10 installed in the enlarged sail 12 of a future submarine 14. System 10 has a mid ships tow point 'A' where towed array 16 exits submarine 14. Towed array 16 may be a single line array or a multi line array. System 10 has a winch 18 with a large diameter reel 20 which provides storage for the entire array 16 and tow cable 22 when not deployed. The towed array 16 is ducted from the winch 18 to tow point 'A' via a guide path which contains bends at points 'B' and 'C'. The upper sheave 24 at bend point 'B' closest to the winch 18 is free wheeling and imparts no additional tensile loads to the towed array 16. The lower sheave 26 at bend point 'C' is powered so as to pull the array 16 from the winch 18 during the initial phase of deployment. The lower sheave 26 also eliminates any friction otherwise resulting from the bends in the path. Both sheaves 24 and 26 have an effective diameter of at least 36" so as not to unduly stress towed array 16 as it passes over sheaves 24 and 26. Towed array 16 and tow cable 22 pass through guide duct 28 which is aligned with the reel 20 to provide even spooling of the towed array 16 onto the reel 20. Even spooling prevents towed array 16 crossover and evenly distributes the towed array 16 across the face of the reel 20.

Figure 2:
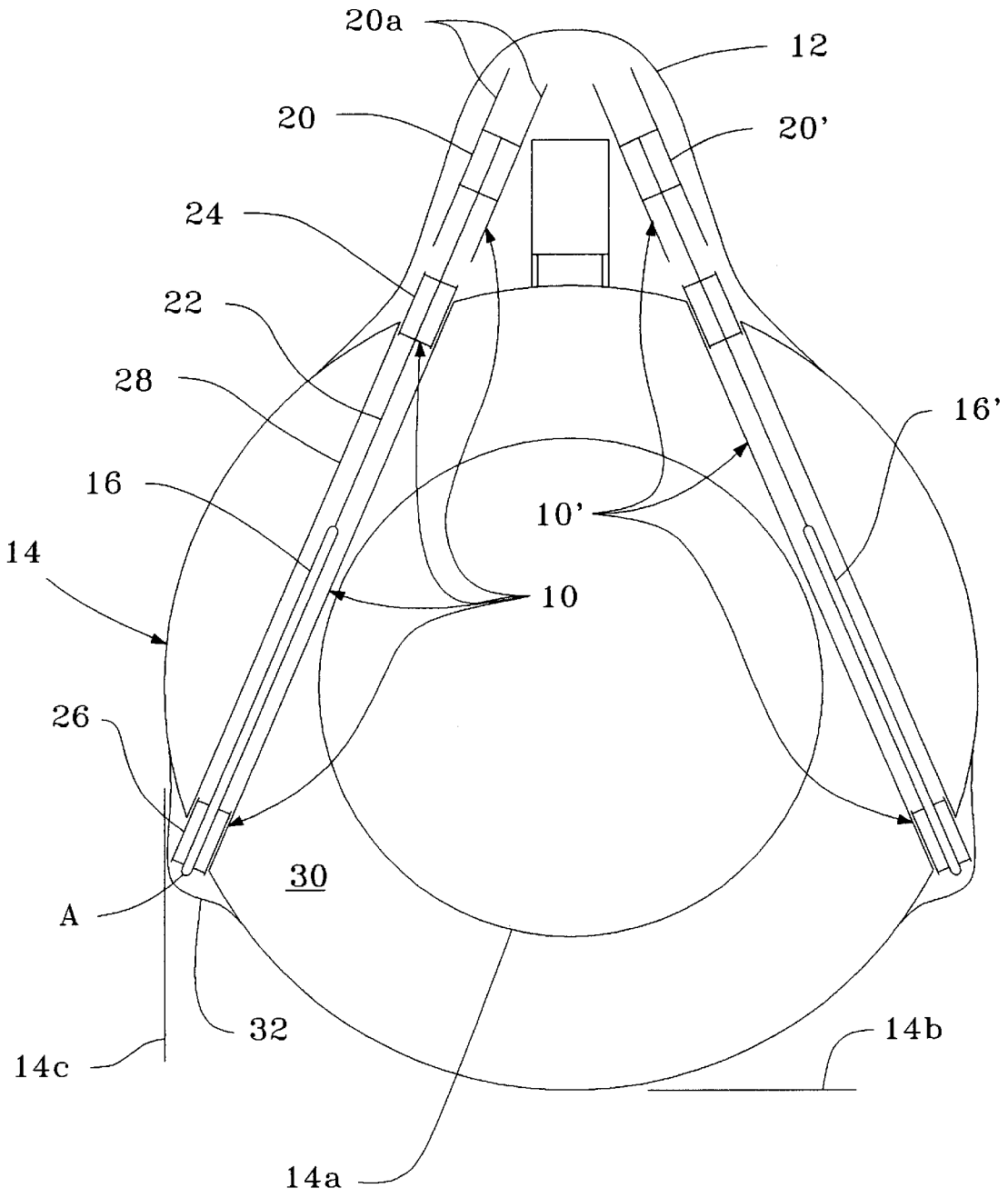
FIG. 2 is a schematic transverse cross section of a future submarine showing the arrangement of the mid ships tow point single line/multi line towed array handling system of the present invention.

Referring now additionally to FIG. 2, a schematic cross section of handling system 10 within sail 12 of future submarine 14 is shown. The guide duct 28 is in line with and centered with flanges 20*a* of reel 20. In addition, the planes of sheaves 24 and 26 are aligned with the plane of reel 20. Upper sheave 24 and winch 18 are separated a sufficient distance to enhance even spooling of towed array 16 onto reel 20. Winch 18 and lower sheave 26 are powered by electric motors or other suitable means. With the alignment of the guide duct 28 and reel 20 shown in FIG. 2, the towed array 16 travel path is through ballast tank 30, clearing the pressure hull 14a of the submarine 14. Shroud 32 is provided at tow point 'A', where towed array leaves submarine 14, and encloses lower sheave 26. The travel path places tow point 'A' and shroud 32 in an area where it will not extend below the keel 14b or outside the beam 14c of the submarine 14. The guide duct 28 is welded into both ends of the ballast tank 30 to maintain the integrity of ballast tank 30. It can be seen from FIG. 2 that the enlarged sail 12 can incorporate a dual handling system 10', such that two towed arrays, 16 and 16', can be deployed from reel 20 and reel 20', respectively. It can be seen that either of the arrays 16 and 16' can be single line or multi line arrays.

In operation, powered lower sheave 26 pulls towed array 16 from reel 20, through guide duct 28 and out tow point 'A'. Winch 18, through reel 20, applies the full tension to towed array 16 as it is deployed and retrieved. When locked, the winch 18 applies the full towed array 16 streaming tension during high speed tow. During initial towed array 16 deployment, submarine 14 may have to execute a turning maneuver to assure that the end of towed array 16 will be carried away from submarine 14 to avoid possible ingestion into the propulsor (not shown). Once the end of the towed array 16 passes the propulsor, the planned propulsor screw shroud (not shown) of future submarine 14 will prevent entanglement in the screw during subsequent maneuvers. By weighting the end of tow cable 22 adjacent towed array 16, additional separation of towed array 16 from the submarine 14 can be achieved.

The mid ships tow point single line/multi line towed array handling system thus described is compatible with the characteristics considered necessary for handling multi line towed arrays, i.e., the use of a large diameter, narrow faced reel for storage of both single line and multi line arrays and for applying the total retrieval tension; ducting the arrays through a guide duct having the minimum number of bends; maneuvering the array through the bends using a simple powered transfer device such as a single sheave; and aligning the plane of the single curve with the plane of the winch to affect even spooling of the array onto the reel. The placement of the handling system within the sail allows for a dual handling system and better maintenance accessibility to the winch and other system components than is available with the current handling system located in the aft ballast tank. The handling system of the current invention eliminates the need for the rollerized, complex curvature guide duct and dual drum capstan of the present handling system which, together, will result in extended array life and improved handling system reliability/availability. Further, tests have indicated that, even using current ship operational retrieval procedures, the multi line handling system of the current invention will be less stressful to some existing towed arrays than handling on the current system. The simplicity and accessibility of the handling system of the current invention will significantly enhance array life, handling system reliability and total system availability.

Although the present invention has been described relative to a specific embodiment thereof, it is not so limited. For example, the exact location within the enlarged sail and the sizes of the reel and sheaves will depend on the final sail configuration of future submarines, though the general layout will be as shown in FIGS. 1 and 2.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A towed array handling system installed in an enlarged sail of a submarine, the system comprising:

a reel having a diameter large enough to store the towed array;

a turning sheave directing the towed array from the reel into a ballast tank of the submarine; and a powered sheave, the powered sheave being activated during deployment of the towed array, the powered sheave pulling the towed array from the reel, around the turning sheave, through the ballast tank, around the powered sheave and forcing the towed array to exit the submarine through a tow point.

2. The towed array handling system of claim 1 wherein the reel provides a primary inhaul force to pull the towed array onto the reel when a deployed towed array is retrieved.

3. The towed array handling system of claim 2 wherein the reel provides a tensile force on the towed array when the towed array is deployed, the tensile force maintaining a deployed length of the towed array.

4. The towed array handling system of claim 1 further comprising:

a first guide duct extended between the reel and the turning sheave; and a second guide duct extended between the turning sheave and the powered sheave, the towed array passing through the first and second guide ducts.

5. The towed array handling system of claim 4 wherein the second guide duct passes through and is sealed against the ballast tank to prevent fluid communication between the guide duct and the ballast tank.

6. The towed array handling system of claim 1 further comprising a shroud affixed to an exterior surface of the submarine, the shroud enclosing the powered sheave.

7. The towed array handling system of claim 6 wherein the shroud encompasses the tow point.

8. The towed array handling system of claim 1 wherein the reel, the turning sheave and the powered sheave rotate within a common plane.

9. A towed array handling system installed in an enlarged sail of a submarine, the system comprising:

a reel having a diameter large enough to store the towed array;

a turning sheave directing the towed array from the reel into a ballast tank of the submarine;

a powered sheave being activated during deployment of the towed array, the powered sheave pulling the towed array from the reel, around the turning sheave, through the ballast tank, around the powered sheave and forcing the towed array to exit the submarine, the powered sheave rotating in a common plane with the reel and the turning sheave; and a shroud enclosing the powered sheave, the shroud forming a tow point, the towed array exiting the submarine through the tow point of the shroud.

10. A towed array handling system installed in an enlarged sail of a submarine, the system comprising:

a first reel having a diameter large enough to store at least one of a single line towed array and a multi line towed array;

a second reel having a diameter large enough to store at least one of a single line towed array and a multi line towed array;

a first turning sheave directing the at least one single line towed array and multi line towed array from the first reel into a ballast tank of the submarine;

a second turning sheave directing the at least one single line towed array and multi line towed array from the second reel into the ballast tank of the submarine;

a first powered sheave being activated during deployment of the at least one single line towed array and multi line towed array, the first powered sheave pulling the at least one single line towed array and multi line towed array from the first reel, around the first turning sheave, through the ballast tank, around the first powered sheave and forcing the at least one single line towed array and multi line towed array to exit the submarine, the first powered sheave rotating in a common plane with the first reel and the first turning sheave;

a second powered sheave being activated during deployment of the at least one single line towed array and multi line towed array, the second powered sheave pulling the at least one single line towed array and multi line towed array from the second reel, around the second turning sheave, through the ballast tank, around the second powered sheave and forcing the at least one single line towed array and multi line towed array to exit the submarine, the second powered sheave rotating in a common plane with the second reel and the second turning sheave;

a first shroud enclosing the first powered sheave, the first shroud forming a first tow point, the at least one single line towed array and multi line towed array from the first reel exiting the submarine through the first tow point of the first shroud; and a second shroud enclosing the second powered sheave, the second shroud forming a second tow point, the at least one single line towed array and multi line towed array from the second reel exiting the submarine through the second tow point of the second shroud.

* * * * *